US005784815A

United States Patent [19]

Hermanson

[11] Patent Number: 5,784,815

[45] Date of Patent: Jul. 28, 1998

[54] LIGHTED SCULPTURE WITH PLURAL SYNCHRONIZED MOTIONS

[75] Inventor: Terry Hermanson, New York, N.Y.

[73] Assignee: Mr. Christmas Incorporated, New York, N.Y.

[21] Appl. No.: 725,700

[22] Filed: Oct. 4, 1996

Related U.S. Application Data

[60] Provisional application No. 60/004,848 Oct. 5, 1995.

[51] Int. Cl.[6] ..... G09F 19/08

[52] U.S. Cl. ..... 40/414; 40/419; 40/540; 446/358

[58] Field of Search ..... 40/414, 418–420, 40/411, 540; 446/354, 358, 298

[56] References Cited

U.S. PATENT DOCUMENTS

| | | | |
|---|---|---|---|
| 2,180,951 | 11/1939 | Dale | 446/354 X |
| 2,641,867 | 6/1953 | McEntyre et al. | 40/419 X |
| 3,722,136 | 3/1973 | Thorn et al. | 446/354 |
| 3,775,900 | 12/1973 | Thorn et al. | 446/354 |
| 3,851,418 | 12/1974 | Barlow et al. | 446/354 X |
| 3,858,353 | 1/1975 | Glass et al. | 446/354 |
| 4,778,432 | 10/1988 | Yeu | 446/354 X |
| 4,875,886 | 10/1989 | Sung | 446/354 X |

*Primary Examiner*—William Stryjewski
*Attorney, Agent, or Firm*—Fitzpatrick, Cella, Harper & Scinto

[57] ABSTRACT

An animated display device includes a vertical main shaft, a body rotatably secured to the main shaft, and a drive device for driving the body to oscillate about the main shaft. In one embodiment, the display device also includes a rotatable appendage secured to the main body and a linkage for converting oscillating movement of the body about the main shaft into oscillating movement of the appendage. In another embodiment, the body is secured to a horizontal shaft which oscillates about the vertical shaft, and the body is also oscillatable about the horizontal shaft. The linkage converts the oscillating movement of the horizontal shaft about the main shaft into oscillating movement of the body about the horizontal shaft.

56 Claims, 9 Drawing Sheets

LIGHTED SCULPTURE WITH PLURAL SYNCHRONIZED MOTIONS

This application is a continuation of provisional application Ser. No. 60/004,848, filed Oct. 5, 1995.

BACKGROUND OF THE INVENTION

1. Field of the Invention

The present invention relates generally to an animated display with movable parts, and more particularly to a lighted sculpture simulating a character or object capable of synchronized motion in two different planes. For example, the sculpture can be shaped like a reindeer that turns from side to side while simulating an up and down prancing motion, or like a snowman that turns while waving its arm.

2. Description of the Related Art

There are many known types of animated displays having movable parts. For example, U.S. Pat. No. 5,416,995 relates to a display device having swinging arms. The display device includes rotary means for swinging the arm in the form of a crystal ball that is rotated by a motor. Two swinging arms are attached by universal joints to a back portion of the display. Each arm includes a coupling link having a coupling head at its end for mounting in a universal rail on the crystal ball. The universal rail is circumferentially, sinuously wound around the spherical surface of the crystal ball. As the crystal ball rotates, the universal rail with endless groove biases the swinging arms about the universal joints to create arm movement.

U.S. Pat. No. 2,273,836 relates to an automated child-like robot which is operated to effect movement of one arm and movement of the head and face. A motor is mounted within the body of the robot and reciprocates two vertical pitmen. One pitman oscillates a shaft through a rocker arm to raise and lower the arm. The other pitman simultaneously oscillates a rocker frame and ultimately a rod to move the head and face. Small incandescent electric lamps are provided in the robot to illuminate the base, eyes and a candle.

Another animated display is shown in FIG. 10. The display of FIG. 10 is in the form of a Santa Claus FIG. 100 made of sculpted heavy gauge wire. The display portions of the figure are illuminated by a string of lights covered by multi-colored plastic tubing. In this display, the arms 102, 104 of the Santa Clause figure synchronously wave. This synchronous movement is generated by a motor 106 which drives a first arm 102 through a first link 108 to oscillate about a pivot. As the first arm 102 oscillates, a second link 100 connected to both the first and second arms oscillates the second arm 104 about another pivot. Thus, a simple design for effecting simple motions in one plane is provided.

However, the animated displays discussed above have certain limitations and drawbacks. For example, the displays of the two above-noted patents are of relatively complex designs and would be expensive to manufacture. Furthermore, the display of the Santa Claus figure discussed above only provides movement in a single plane. An improved display having a simple mechanism for allowing oscillating, synchronous movement in more than one plane and in at least two transverse axes is desirable.

SUMMARY OF THE INVENTION

It is a principal object of the present invention to provide an animated figure that is capable of oscillating, synchronous movement in different planes and about two transverse axes.

Another object of the invention is to provide an animated figure having a simple mechanism for effecting oscillating, synchronous movement in different planes and about two transverse axes in a reliable manner.

Still another object of the invention is to provide an animated figure that is both illuminated and capable of oscillating, synchronous movement in different planes and about two transverse axes in a simple yet reliable manner.

Yet another object of the invention is to provide an attractive holiday display that can be manufactured and sold at a reasonable cost.

It is yet another object of the present invention to provide an animated figure comprised of such materials that are suitable for both indoor and outdoor use.

In one aspect of the present invention an animated display device comprises a main shaft having a first axis, a display rotatably secured to the main shaft, the display including a first portion, driving means for driving the display to oscillate about the main shaft in a primary motion, and means for converting the primary motion of the display into a secondary motion. The first portion moves in both the primary and secondary motions.

In another aspect of the present invention an animated display device comprises a main shaft having a first axis, a body rotatably secured to the main shaft, an appendage rotatably secured to the body for rotation about a second axis transverse to the first axis, driving means for driving the body to oscillate about the first axis of the main shaft, and means for converting oscillating movement of the body about the first axis of the main shaft into oscillating movement of the appendage about the second axis.

In yet another aspect of the present invention an animated display device comprises a main shaft having a first axis, a secondary shaft having a second axis transverse to the first axis and being rotatably secured to the main shaft to oscillate in a first plane transverse to the first axis of the main shaft, a body rotatably secured to the secondary shaft to oscillate with the secondary shaft about the first axis of said main shaft and about the second axis of the secondary shaft in planes transverse to the second axis, driving means for driving the secondary shaft to oscillate about the first axis of the main shaft, and means for converting the oscillating movement of the secondary shaft about the first axis into the oscillating movement of the body about the second axis.

In still another aspect of the present invention an animated display device comprises frame means for supporting a display, the frame means including a fixed main shaft having a first axis, a display supported by the frame means, the display having a first portion rotatably secured to the main shaft for oscillation about the first axis and a second portion rotatably secured to the first portion for oscillation about a second axis transverse to the first axis, driving means for driving the first portion of the display to oscillate about the first axis of the main shaft, and a linkage for converting oscillating movement of the first portion into oscillation of the second portion about the second axis.

In yet a further aspect of the present invention an animated display device comprises frame means for supporting a display, the frame means including a fixed main shaft having a first axis and a secondary shaft having a second axis and rotatably fixed to the main shaft, a display supported on the frame for oscillation about the first axis of the main shaft and oscillation about the second axis of the secondary shaft, driving means for driving the display to oscillate about the first axis of the main shaft, and a linkage for converting oscillation of the display about the first axis into oscillation of the display about the second axis.

These and other objects, aspects, features and advantages of the present invention will become apparent from the following detailed description of the preferred embodiments taken in conjunction with the accompanying drawings.

DETAILED DESCRIPTION OF THE PREFERRED EMBODIMENT

Figure 1:
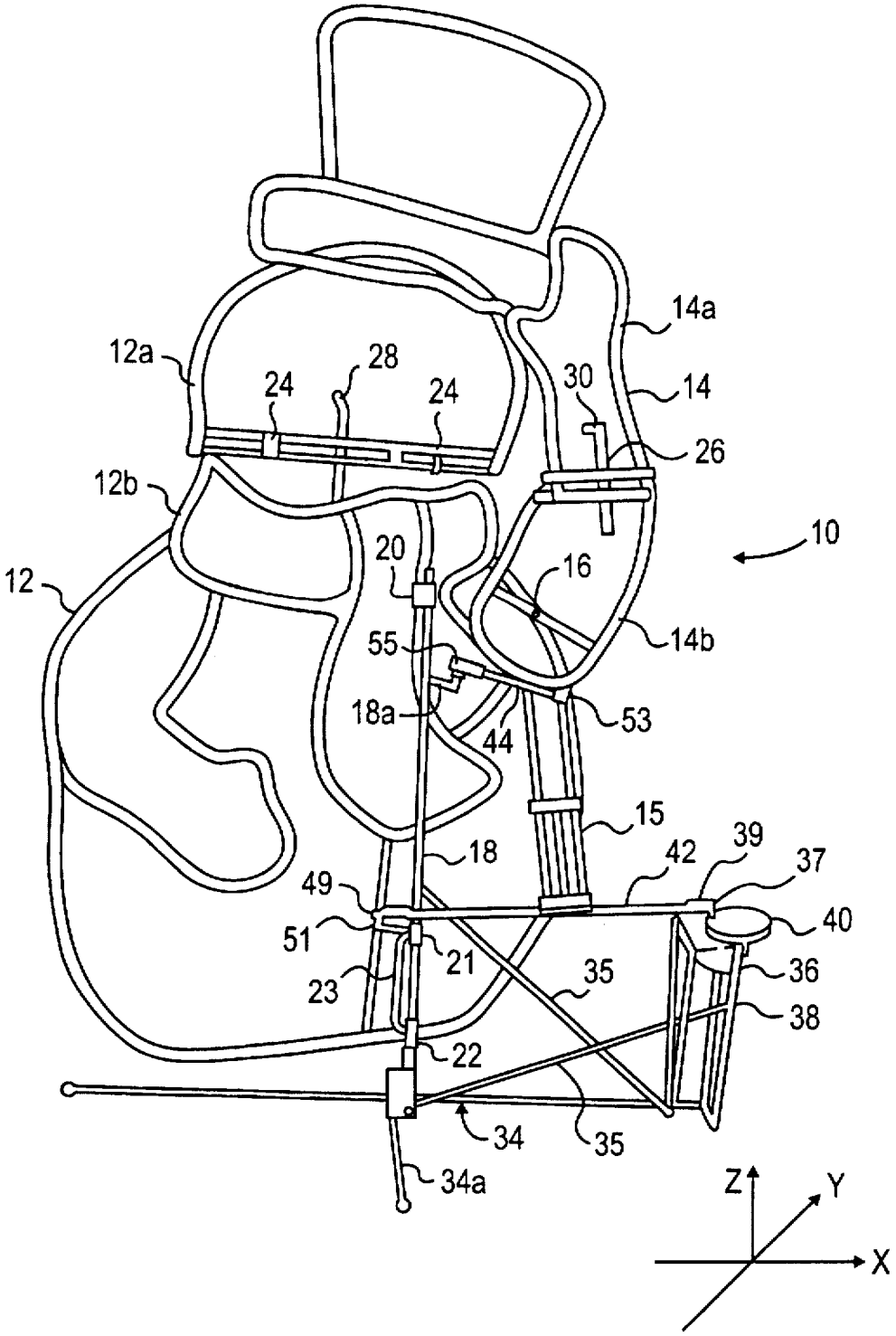
FIG. 1 is a perspective rear view of the display of the first embodiment of the present invention in a first position.

Referring to FIG. 1, reference numeral 10 generally identifies the animated light display of a first embodiment of the present invention. The display is comprised of a main frame or body 12, formed of metal rods or heavy gauge wire bent or sculpted into the desired shape. To the body 12 is pivotally attached a movable arm 14, also formed of bent or sculpted metal rods or heavy gauge wire. The arm, or appendage, 14 is pivotally attached to the main body 12 through a bearing journaled onto a stud of shaft (not shown) disposed at pivot point 16 defining a second axis. A counterweight 15 is attached to the arm below pivot point 16 to balance the arm 14. The main body 12 is rotatably secured to a main shaft 18 by bearings 20, 21 and 22. In this embodiment, the bearings 20, 21, 22 can be formed as rigid collars that encircle the main shaft 18. As best seen in FIG. 1, bearings 20 and 22 are affixed directly, as by welding, to the main body 12, and a coupling 23 is secured between bearings 21 and 22. The main shaft 18 is vertically disposed and supported in a frame or stand 34, which will be discussed in detail below. Thus, the entire display 10 is rotatable about a first axis defined by the main shaft 18 and the arm 14 is also rotatable about the second axis of the pivot point 16. FIG. 1 shows that the first axis of the main shaft extends in the z-axis direction of the x-y-z coordinate system, and the second axis, because it oscillates about the first axis, is described as extending in directions parallel to the x-y plane of the coordinate system.

Although the sculpted main body and rotatably attached appendage can be formed in any desired shape, in the illustrated first embodiment a snowman figure doffing and donning his cap is shown. Other figures suitable for the present invention could be a Santa Claus figure doffing and donning his cap or ringing a bell, a Santa Claus figure on a rocking horse, or a holiday message, such as "Merry Christmas," with a moving ornament. Of course, any other desired figure or object with one or more moving parts can be depicted, including non-holiday decorations or advertising displays, without departing from the spirit or scope of the invention.

In order to minimize the size of the figure for shipping and storing, the main body 12 is preferably formed as two foldable or hinged halves **12*a*, 12*b*. Similarly, the appendage 14 is in the form of two hinged halves 14*a*, 14*b*. The two halves are pivotally connected by hinges 24, 26, and retaining pins 28, 30 are used to lock the assemblies in an upright position. The hinges 24 and 26 are designed such that the two halves 12*a*, 12*b* of the body 12 and the two halves 14*a*, 14*b* of the arm 14 can be folded to be substantially parallel. In this manner, wiring for the lighting on the body 12 and arm 14**, to be described later, will not be stretched or pinched, nor will the light bulbs be crushed or unseated. The details of the hinges are described in copending U.S. application Ser. No. 08/236,336, the description of which is incorporated herein by reference. Accordingly, a detailed description of the hinges will not be provided herein.

The vertical shaft 18 is secured to the stand 34 and held in the upright position. The stand 34 can be in the form of a cross and can be of one integral piece, or include a foldable or separately attachable crosspiece **34*a*. For additional reinforcement, stabilizing bars 35 are secured between the stand 34 and the vertical shaft 18** and a motor stand that is discussed below.

Figure 8A:
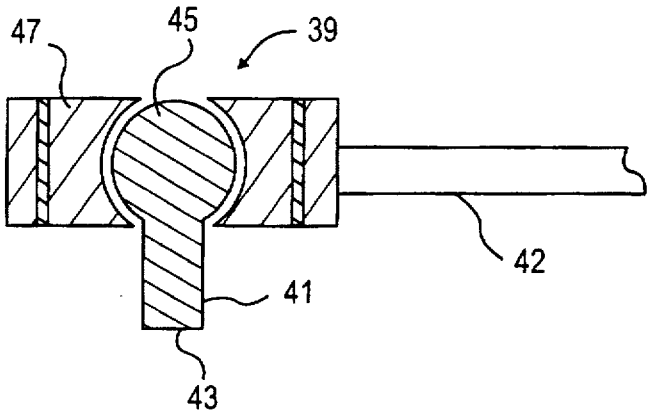
FIG. 8A is a cross-sectional view of a ball and socket joint of the present invention.

An electric, rotary motor 36 is mounted on a motor stand 38, which is preferably secured to at least one leg of the stand 34. This will maintain the motor 36 a predetermined distance away from shaft 18. The motor includes an anti-lock device for protection against burning out the motor. A drive plate or disk 40 is secured to the rotational drive axis of the motor 36 and includes an eccentrically-positioned recess 37 for receiving a universal coupling 39. As shown in FIG. 8A, the universal coupling 39 includes a hollow pin 41 having one end 43 that is received in the recess 37 of the disk 40 and a second spherical end 45 that is secured between two halves of a coupling link 47 in a ball and socket type arrangement to provide the universal motion. Of course, other types of comparable universal couplings for transmitting motion along non-collinear lines can be used without departing from the scope of the invention.

Figure 3:
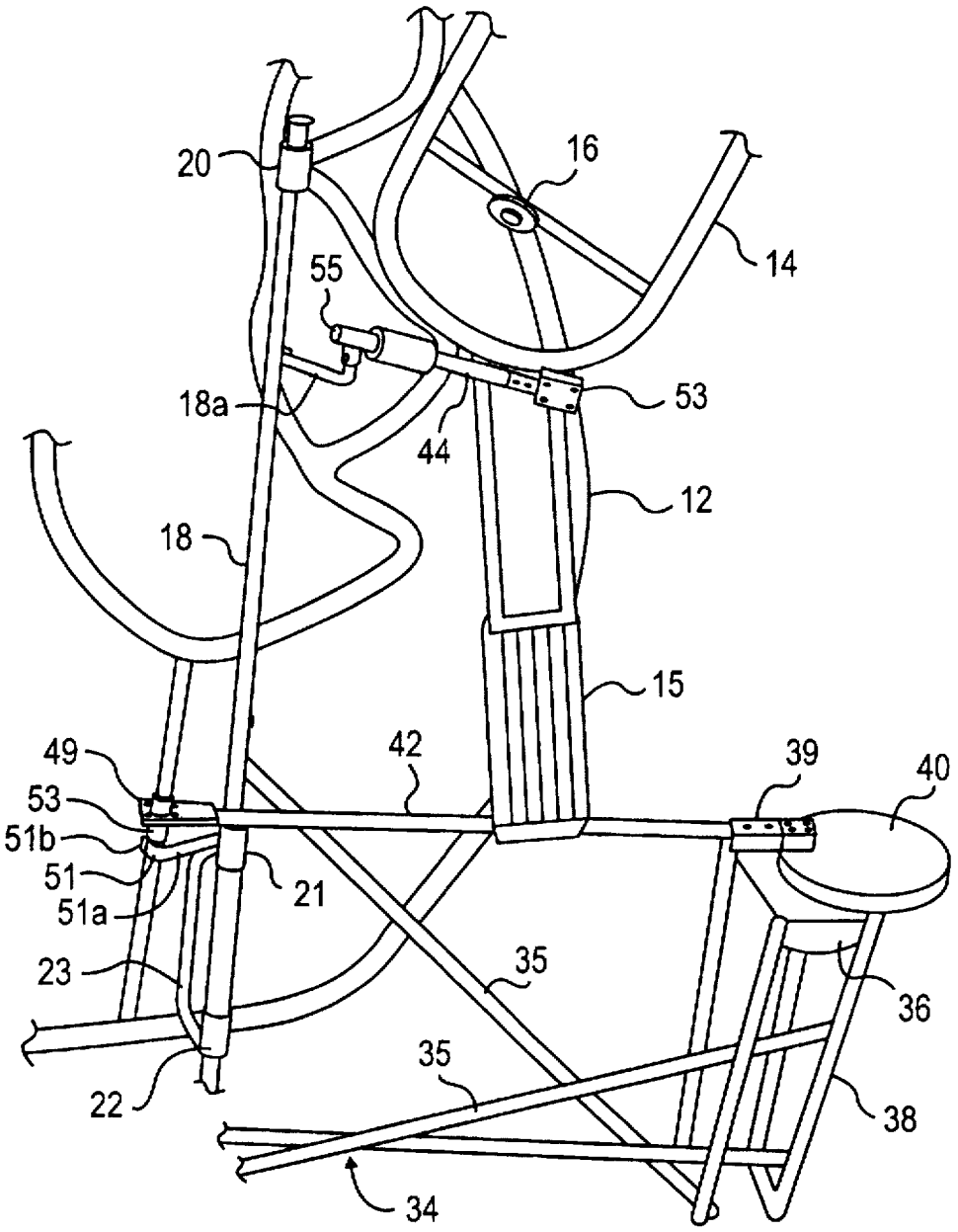
FIG. 3 is a partial perspective view of the drive and linkage systems of the first embodiment of the present invention.

Rotational motion of the disk 40 is translated into oscillating motion of the display by a drive link 42. The drive link 42 is secured at a first end to the universal coupling 39 and at its opposite end to the bearing 21 through another universal coupling 49, which is preferably the same type as coupling 39, and an L-shaped slave lever 51. With reference to FIG. 3, a longer arm **51*a* of the slave lever is affixed, e.g., welded, directly to the bearing 21 and a shorter arm 51*b* is received in a hollow pin 53 of the universal coupling 49. As the motor 36 drives the drive disk 40 to rotate the one end of the drive link 42, the second end of the drive link 42 drives the slave lever 51 back and forth to rotate bearing 21 in an oscillating fashion about the main shaft 18. Since the main body 12 is affixed to the bearing 21 as well as bearings 20 and 22, the main body 12 also oscillates back and forth once about main shaft 18 with each rotation of drive disk 40**.

As the body 12 oscillates, since the arm 14 is connected to the body 12 at the pivot point 16, the arm 14 also oscillates about the first axis of the main shaft 18. However, the arm 15 also is capable of movement about the second axis. This motion is made possible by a link 44 connected between the arm 14 and the main shaft 18. More particularly, and with reference primarily to FIG. 3, both ends of the link 44 are secured to universal couplings 53 and 55 of the same general type as universal coupling 39 described above. The first coupling 53 is secured by its pin portion to a portion of the arm 14 below the pivot point 16. The second coupling 55 is secured by its pin to a rigid extension 18*a* of the main shaft 18. Since the extension 18*a* is stationary and extends away from the axis of shaft 18, as the body 12 rotates in a counter-clockwise direction about the first axis, the distance between the pivot point 16 of the arm 14 and the extension 18*a* increases because the arm is rotating away from the extension 18*a*. As the body 12 rotates in this counter-clockwise direction, the link 44 necessarily maintains a fixed distance between the extension 18*a* and the bottom portion of the arm where the link 44 is connected. As a result, the arm 14 is rotated in a clockwise direction about the pivot point 16 as viewed in FIG. 1. Conversely, when the body 12 rotates in the clockwise direction, the pivot point 16 draws closer to the extension 18*a* and the link 44 acts to push the lower portion of the arm 14 away from the extension 18*a* as shown in FIG. 3. This motion results in the arm being rotated in the counter-clockwise direction as viewed in FIG. 1.

Figure 9:
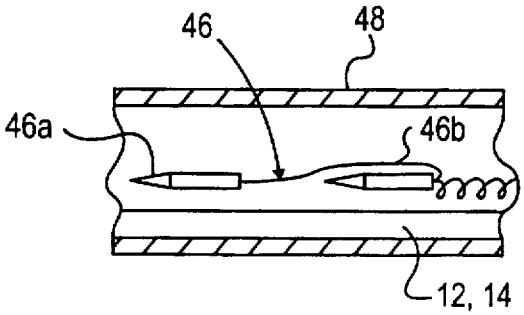
FIG. 9 is a cross-sectional view of a portion of the display of either embodiment of the present invention.
Figure 10:
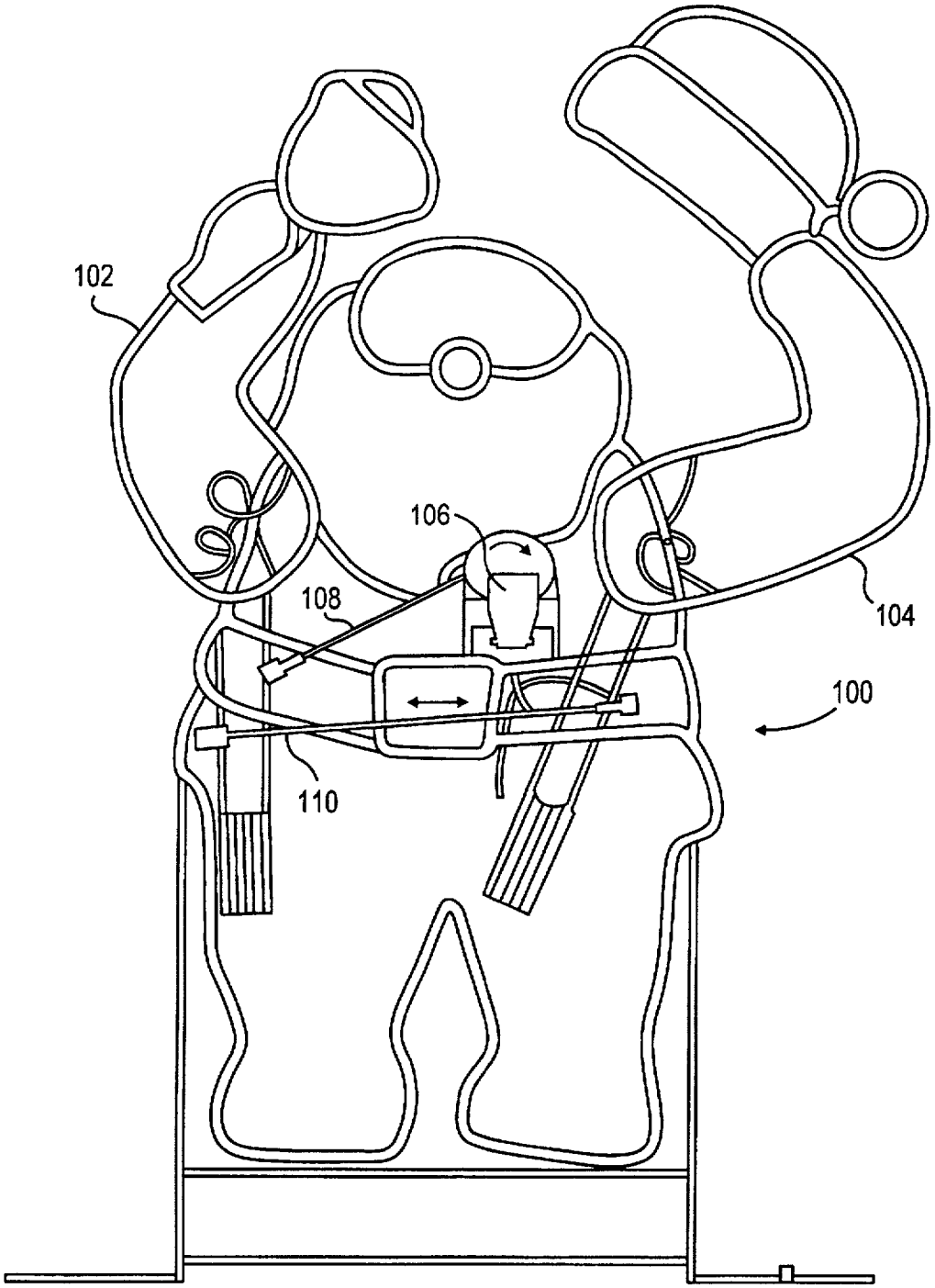
FIG. 10 is a perspective front view of a related display.

The display can be illuminated in the following manner. Connected to the power source for the motor is a string of lights 46 comprising individual bulbs 46*a* connected by wiring 46*b* as shown in FIG. 9. Both the motor 36 and the string of lights 46 can operate on standard U.S. power (120 V AC, 60 Hz) utilizing conventional circuitry. In this embodiment, the string of lights 46 is strung along the display portions of the display FIG. 10. That is, lights are not strung on the entire main body 12 and arm 14, but only those portions that are intended to form a part of the animated figure. For example, only those portions of the main body 12 that form the outline of the snowman, his arms and his scarf, as well as the outline of the arm 14 and his hat are illuminated. The stand 34, motor base 38, counterweight 15 and other structural portions are not illuminated. In this manner, in low light conditions, such as nighttime, only the display portions of the animated display will be readily visible to an observer.

These lights 46 are preferably in the form of a single strand, but can be formed of plural strands for the different parts of the figure. After the string of lights 46 is strung along the display portions of the figure, these display portions are preferably wrapped with flexible tube-like members 48 formed of a translucent material, which can optionally be multi-colored. As to the preferred colors, in the illustrated example, a white or clear translucent tubular member can be used for portions of the figure corresponding to the snowman's body, a red tubular member can be used for portions of the figure corresponding to the snowman's mittens and scarf, and green can be used for the snowman's hat. The translucent tubular members 48 are formed with a longitudinal slit to readily permit wrapping the tubular members 48 around the main body 12 and arm 14. This slit can optionally be formed spirally. The tubular members 48 can be held to the wire forming the main body 12 and arm 14 by wire ties or other suitable means.

The slit in the translucent tubular member 48 also enables individual bulbs 46*a* to be replaced when they burn out. Since the power should be supplied to the string of lights to determine which individual bulbs are burnt out, to prevent motion of the display the coupling 39 can be simply lifted from the eccentric recess 37. The lights 46 can be of a type that are constantly illuminated or a type that flash intermittently. Optionally, the lights can be colored to correspond to the desired colors and only clear tubular members 48 then need be used.

The metal parts of the main body 12, arm 14, main shaft 18, stand 34, etc., are preferably coated with a non-conducting material, such as an epoxy, to protect against electric shock and protect the metal from corrosion.

Figure 2:
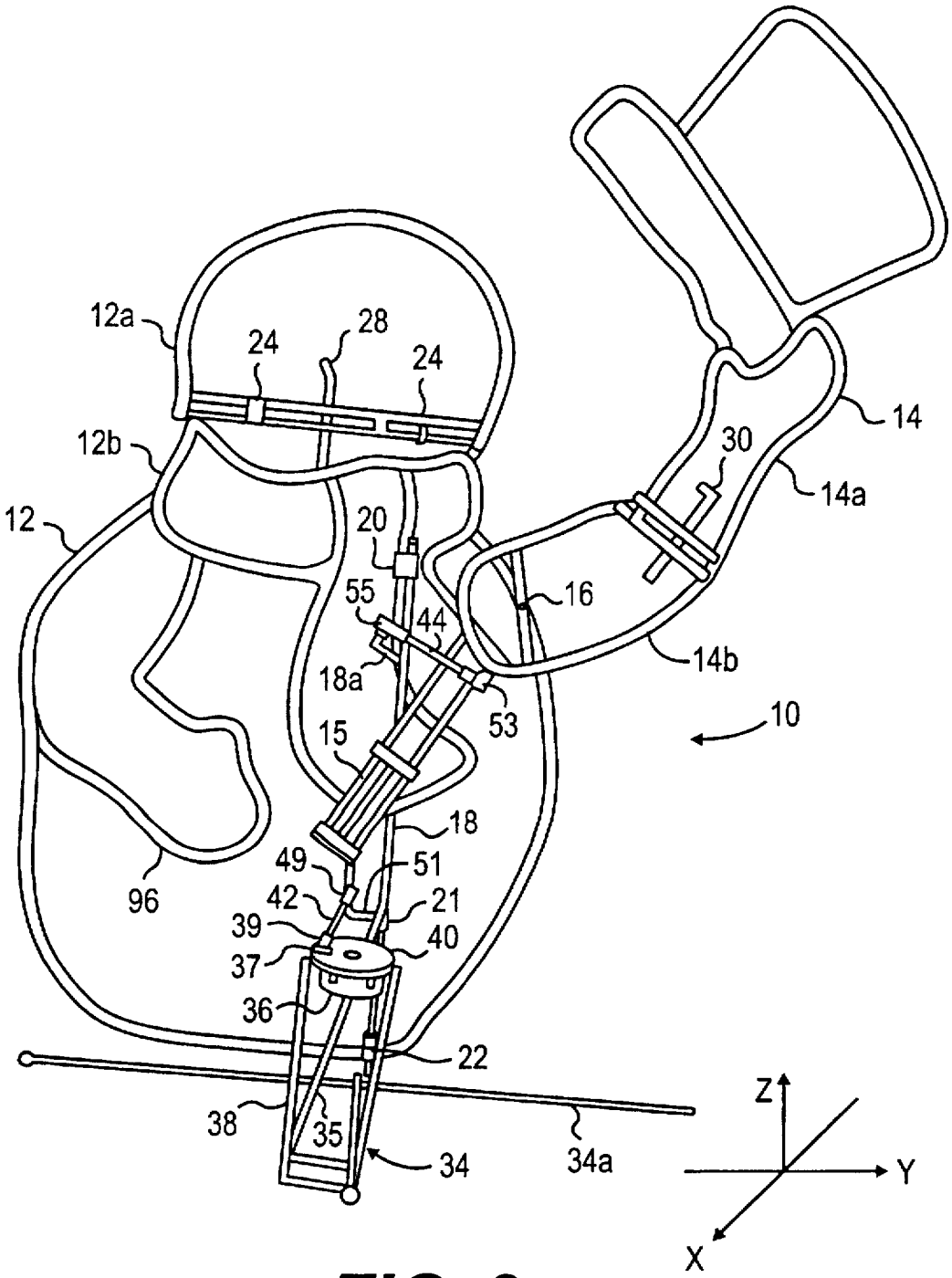
FIG. 2 is a perspective side view of the display of the first embodiment in a second position.

In operation, the motion of the display figure of the first embodiment is created as follows. When electric power is supplied to the rotary motor, the drive plate 40 is rotated in one direction at a constant speed. At the same time, the electric power is also supplied to the string of lights 46 to illuminate the display. As the drive plate 40 rotates, it drives one end of the drive link 42 in a circular path such that the second end of the drive link 42, which is connected to slave lever 51, is cycled back and forth. This cycling motion drives the body 12 to oscillate about the first axis of the main shaft 18. That is, from the position depicted in FIG. 1, the body 12 is rotated to the position depicted in FIG. 2 and then back again for each rotation of the drive plate 40. The body is preferably oscillated about the first axis at least through a 60° range of rotation and even more preferably through a 90° range of motion in this embodiment.

As the pivot point 16 oscillates about the shaft 18, the link 44 rigidly connects the bottom of arm 14 to the stationary extension 18*a* and acts to push and pull the arm about pivot point 16. Thus, the arm 14 oscillates about pivot point 16 synchronously with oscillating movement of the body 12 about main shaft 18. As will be appreciated, in the first embodiment, the snowman figure appears to be doffing his hat as he twists in one direction, while donning his hat while twisting in the opposite direction.

Referring to FIGS. 4–7, a second embodiment of the present invention will be described. Elements similar to those in the first embodiment are labelled with the same reference numerals. As in the first embodiment, a display 50 is journaled to a fixed main shaft 18 by collar-type bearings 57, 58 and 59. The main shaft 18 is secured to the stand 34. The main shaft 18 also defines a first axis extending in the z-direction of the coordinate system shown in FIG. 4. The display includes a drive shaft 60 running substantially parallel to the main shaft 18 and affixed to each of the bearings. Additional details of the drive shaft will be described below.

Figure 6:
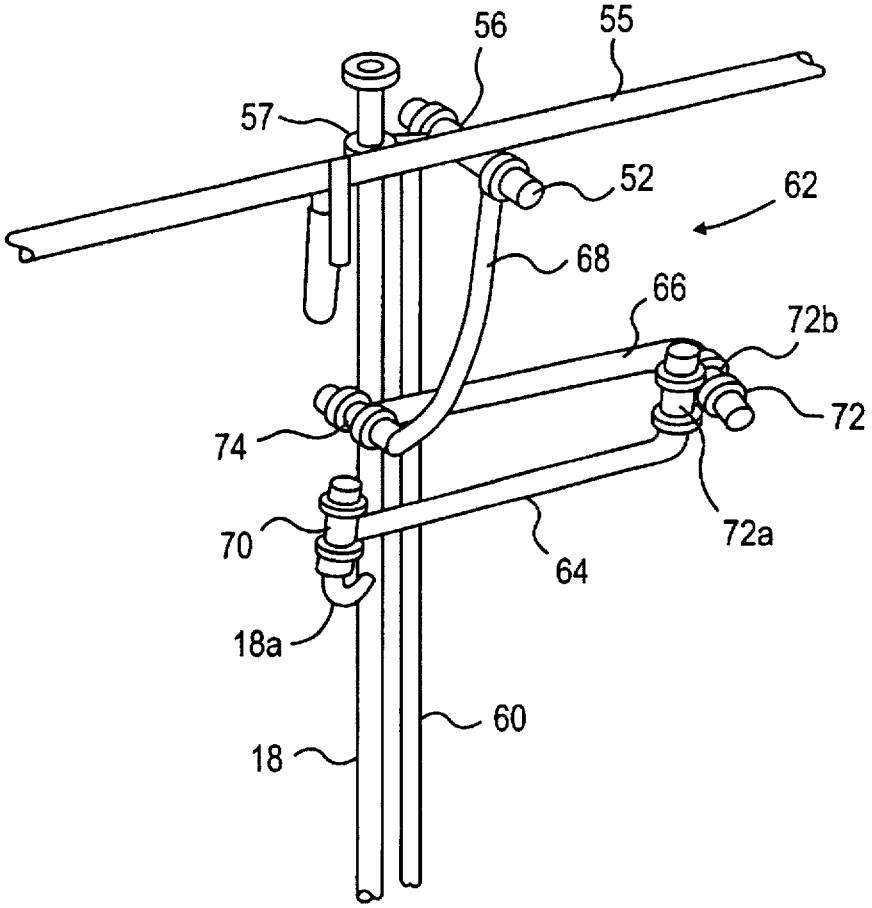
FIG. 6 is a perspective view of the linkage system of the second embodiment in the first position.
Figure 7:
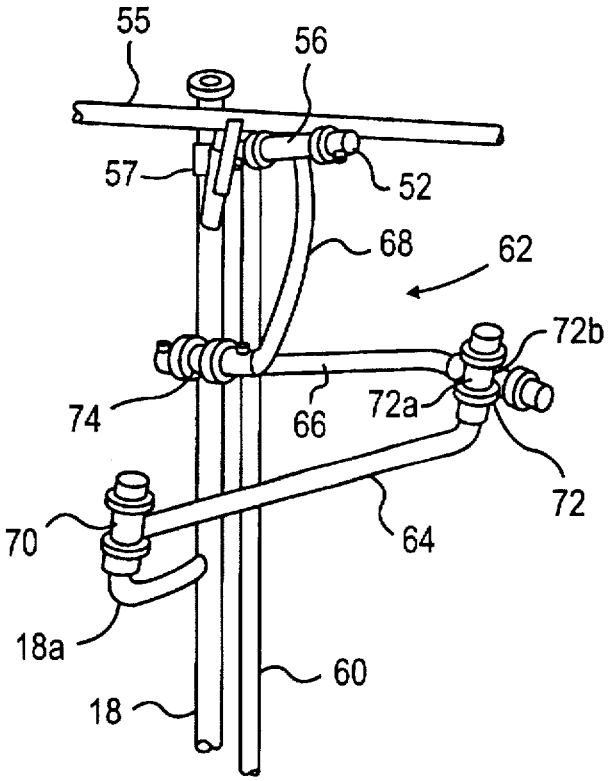
FIG. 7 is a perspective view of the linkage system of the second embodiment in the second position.

As best seen in FIGS. 6 and 7, a secondary shaft 52 is rotatably connected to the main shaft 18 so that it is rotatable in an x-y plane about the main shaft 18. A bearing 56 is journaled onto the horizontal shaft 52. A main body 54 of the display 50 is affixed to the bearing 56 by a transverse support 55 such that the main body is rotatable with the shaft 52 and bearing 56 about the first axis of the main shaft 18 and is also rotatable with the bearing 56 about the second axis of the secondary shaft 52.

As with the first embodiment, the sculpted main body of the second embodiment can be formed in any desired shape. However, in the illustrated second embodiment, a pair of prancing reindeer is shown.

Also, as with the first embodiment, the main body 54 is preferably formed as two foldable halves 54*a*, 54*b* in order to minimize the size of the figure for shipping and storing.

The drive link 42 having one end connected to the eccentric recess 37 of the drive plate 40, has its second end connected to a drive arm 58*a* of a bearing 58, which is rotatably secured to the main shaft 18. The parallel vertical drive shaft 60 is also rotatably secured to the main shaft 18 at bearings 57, 58 and 59, and is affixed at bearing 58 to the secondary shaft 52. Thus, forces applied to drive arm 58*a* create a rotational force in bearing 58, which is transmitted through the drive shaft 60 to the secondary shaft 52, causing it to rotate about the first axis of the main shaft 18. This motion causes the body 54, which is secured to bearing 56 journaled to shaft 52, to also rotate about main shaft 18.

Figure 8B:
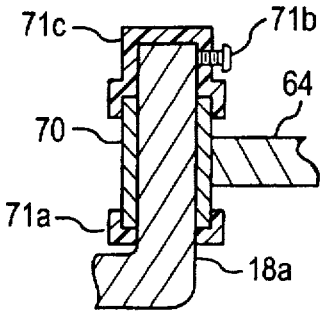
FIG. 8B is a cross-sectional view of a single-axis bearing of the present invention.
Figure 8C:
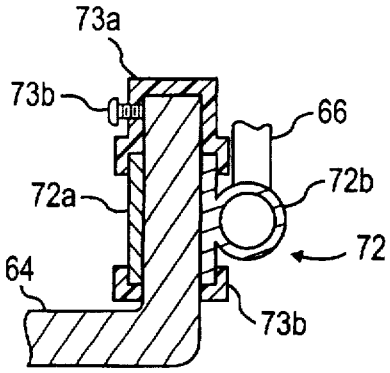
FIG. 8C is a cross-sectional view of a double-axis bearing of the present invention.

The oscillating movement of the bearing 56 and main body 54 about the first axis of the main shaft 18 is also converted into oscillating movement of the bearing 56 about the second axis of the secondary shaft 52 by way of a linkage 62, which is more clearly seen in FIGS. 6 and 7. The linkage 62 is comprised of three main links 64, 66 and 68. The first link 64 has one end affixed to a single-axis bearing 70, which is journaled to an extension 18*a* affixed to the main shaft 18. As shown in detail in FIG. 8B, the bearing 70 is secured to extension 18*a* by being sandwiched between end caps 71*a* which are affixed to extension 18*a* by set screws 71b or other suitable means. The end caps 71*a* can also retain grease or any other desired lubricant for the bearing. The first bearing 70 allows the link 64 to pivot about an axis substantially parallel to the first axis of the main shaft 18. The extension 18*a* is offset a predetermined distance from the main shaft 18. The other end or free end of the link 64 is connected to a first component 72*a* of a double-axis bearing 72 shown in detail in FIG. 8C. The double-axis bearing is also secured by caps 73*a* and set screws 73*b*.

The second link 66 has one end connected to a second component 72*b* of a double-axis bearing 72. The first component 72*a* of the double-axis bearing 72 allows each point on link 66 to move in substantially horizontal x-y planes, whereas the second component 72*b* allows points on link 66 to move in substantially vertical planes with respect to the spatial orientation of this embodiment. The other end of the link 66 is affixed to a single-axis bearing 74, similar in design to bearing 70 and to which a free end of a third link 68 is journaled. As best seen in FIG. 6, the first and second links 64 and 66 are approximately the same length and the third link 68 is slightly arcuate in shape. Thus, the links 66 and 68 can move relative to one another in a vertical plane. The other end of the link 68 is affixed to the bearing 56 which, as described above, is journaled to the secondary shaft 52. With this arrangement, any rotational movement of the third link 68 about the secondary shaft 52 causes the bearing 56 and the main body 54 to likewise rotate about the secondary shaft 52.

As will be appreciated, the linkage 62 as described above links bearing 56, which is rotatable in a horizontal plane about the first axis of the shaft 18 and also rotatable about the second shaft 52, to stationary extension 18*a*. In this manner, any relative movement between the bearing 56 and the stationary extension 18*a* affects the arrangement of linkage 62. The linkage 62 is designed such that relative movement between the secondary shaft 52 and the extension 18*a* in one direction causes the bearing 56 to rotate in a certain direction about the secondary shaft 52. Conversely, relative movement between the horizontal shaft 52 and the extension 18*a* in the opposite direction causes rotational movement of the bearing 56 in its opposite direction about the secondary shaft 52.

The display of the second embodiment can be illuminated in a similar manner as in the first embodiment. As for the preferred colors of the tube-like members 48, the bodies of the pair of prancing reindeer can be clear or white, the antlers yellow and the hooves and noses red.

Thus assembled, the motion of the display figure of the second embodiment is as follows. When electric power is supplied to the rotary member 36, drive plate 40 is rotated in one direction at a constant speed. At the same time, the electric power is also supplied to the string of lights 46 to illuminate the display. As the drive plate 40 rotates, one end of the drive link 42 is moved in a circular path such that the second end of the drive link 42, connected to the drive arm 58*a* of the bearing 58, is cycled in clockwise and counter-clockwise directions about main shaft 18. This cycling motion is driven through the parallel drive shaft 60 to the secondary shaft 52. This oscillating motion of secondary shaft 52 in a horizontal plane about the first axis of the main shaft 18 drives the body 54 to oscillate in clockwise and counter-clockwise directions about the main shaft 18.

The oscillation of the main body about the main shaft 18 causes the distance between the secondary shaft 52 and the extension 18*a* to change, which sets the linkage in motion to rotate the bearing 56 and oscillate the main body about the second axis of the secondary shaft 52.

Figure 4:
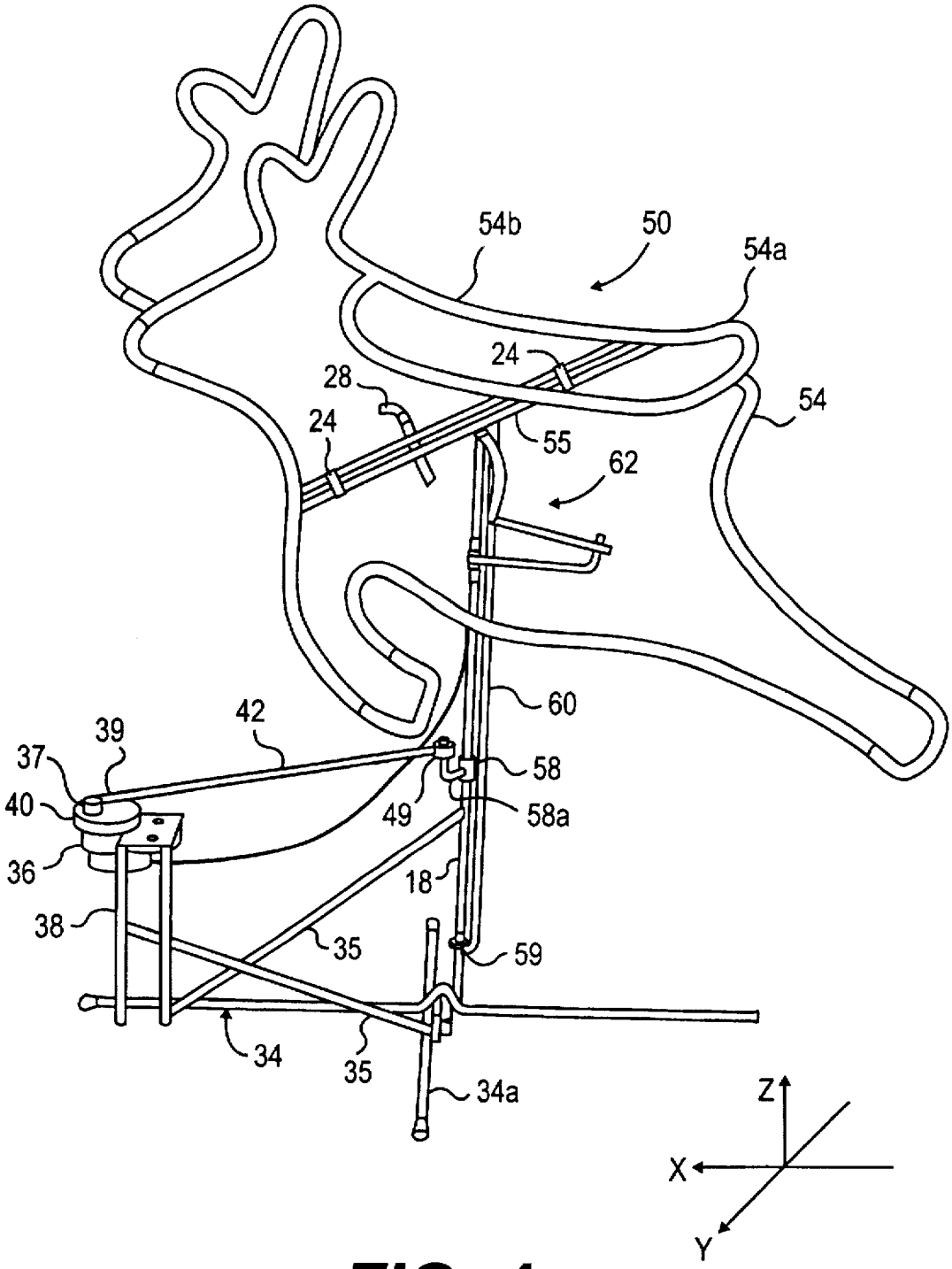
FIG. 4 is a perspective front view of the display of the second embodiment of the present invention in a first position.
Figure 5:
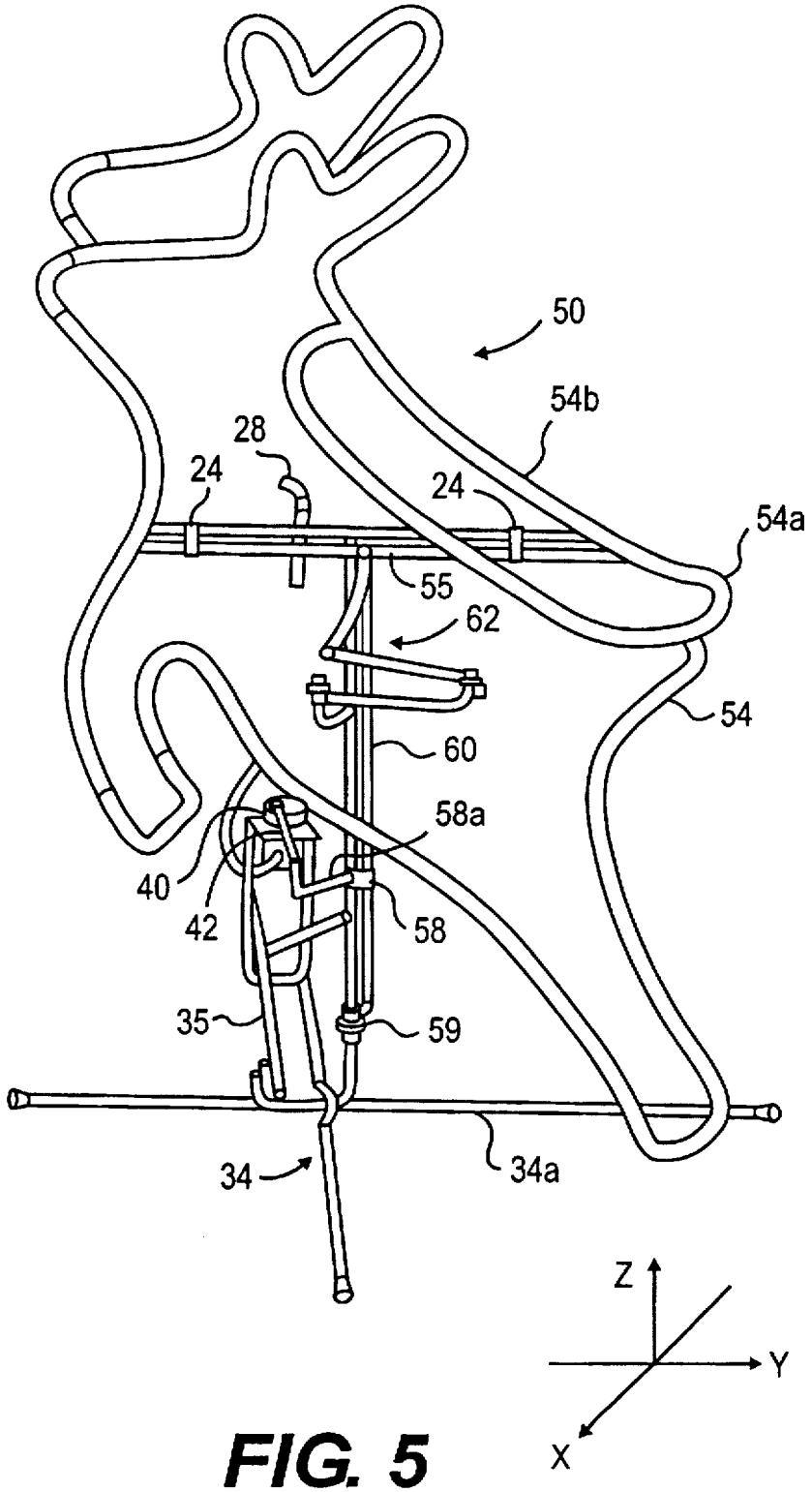
FIG. 5 is a perspective side view of the display of the second embodiment in a second position.

In more detail, as the motor rotates through the first half of its cycle, the main body 54, from its position shown in FIG. 4, is caused to rotate in a counter-clockwise direction about the main shaft 18, and simultaneously, in a clockwise direction about horizontal shaft 52, to the position shown in FIG. 5. Due to this motion, the linkage 62 from its orientation shown in FIG. 6 is manipulated to the orientation shown in FIG. 7. Conversely, as the motor completes the second half of its cycle, the main body is rotated in a clockwise direction about the main shaft 18 and simultaneously in a counter-clockwise direction about the secondary shaft 52. At the end of the cycle, the linkage 62 is again positioned as shown in FIG. 6. Thus, the reindeer appear to be prancing to a viewer.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

I claim:

1. An animated display device comprising:

a main shaft having a first axis;

a display rotatably secured to said main shaft, said display including a first portion;

driving means for driving said display to oscillate about said main shaft in a primary motion; and means for converting the primary motion of said display into a secondary motion, wherein said first portion moves in both the primary and secondary motions.

2. A device according to claim 1, wherein said driving means comprises an electric rotary motor.

3. A device according to claim 2, further comprising a drive disk affixed to said rotary motor and a driving link eccentrically connected to said drive disk, wherein said drive disk serves as a crank for moving said display in the oscillating primary motion about said main shaft.

4. A device according to claim 1, wherein said display comprises a sculpted frame formed of metal wire.

5. A device according to claim 1, wherein said first portion comprises said display in its entirety.

6. A device according to claim 5, wherein said converting means comprises a linkage for converting the primary motion of said display about said main shaft into the secondary motion of said display about a secondary shaft having a second axis transverse to the first axis, said secondary shaft being rotatably connected to said main shaft and being movable in a plane transverse to the first axis of said main shaft, such that said driving means and said converting means cause said display to synchronously oscillate about said main shaft and oscillate about said secondary shaft.

7. A device according to claim 6, wherein when said display rotates in a clockwise direction about said main shaft, said converting means causes said display to synchronously rotate in a counter-clockwise direction about said secondary shaft.

8. A device according to claim 6, wherein said linkage comprises a series of links connected between a first bearing rotatable about an axis parallel to the first axis of said main shaft and a second bearing rotatable about said secondary shaft, said display being affixed to said second bearing.

9. A device according to claim 8, wherein the series of links in said linkage include a first link affixed to said first bearing and extending in a second plane substantially parallel to the second axis and being rotatable with said first bearing in the second plane, a second link affixed to said second bearing, said second link being rotatable in planes substantially parallel to the first axis, and a third link having one end connected to a free end of said first link and an opposite end connected to a free end of said second link, said third link being movable relative to the free end of said first link in dual planes transverse to one another, and relative to the free end of said second link in planes substantially parallel to the first axis.

10. A device according to claim 9, wherein upon rotation of said secondary shaft about the first axis of said main shaft said first, second, and third links of said linkage interact to urge said second link to rotate said second bearing about said secondary shaft.

11. A device according to claim 9, wherein said first and third links are interconnected with a double-axis bearing and said second and third links are interconnected with a single-axis bearing.

12. A device according to claim 1, wherein said first portion comprises an appendage rotatably secured to a secondary shaft affixed to said display and extending along a second axis transverse to the first axis.

13. A device according to claim 12, wherein said converting means converts the first motion of said display about said main shaft into the secondary motion, which comprises oscillation of said appendage about said secondary shaft.

14. A device according to claim 13, wherein said converting means comprises a linkage for converting the oscillating movement of said display about the main shaft into the oscillating movement of said appendage about said secondary shaft.

15. A device according to claim 14, wherein when said display rotates in a clockwise direction about said main shaft, said converting means causes said appendage to rotate in a clockwise direction about said secondary shaft.

16. A device according to claim 14, wherein said linkage comprises a link, with one end of said link being attached to said main shaft and the other end attached to said appendage.

17. A device according to claim 16, wherein said link is attached to said main shaft and said appendage via ball joints.

18. A device according to claim 12, wherein said appendage is rotatable in a plane parallel to an instant plane of said display.

19. A device according to claim 12, wherein said appendage includes a counterweight extending below a connection with said horizontal shaft.

20. An animated display device comprising:

a main shaft having a first axis;

a body rotatably secured to said main shaft;

an appendage rotatably secured to said body for rotation about a second axis transverse to the first axis;

driving means for driving said body to oscillate about the first axis of said main shaft; and means for converting oscillating movement of said body about the first axis of said main shaft into oscillating movement of said appendage about the second axis.

21. A device according to claim 20, wherein said driving means comprises an electric rotary motor.

22. A device according to claim 21, further comprising a drive disk affixed to said rotary motor and a driving link eccentrically connected to said drive disk, wherein said drive disk serves as a crank for moving said body in the oscillating motion about the first axis of said main shaft.

23. A device according to claim 20, wherein said body comprises a sculpted frame formed of metal wire.

24. A device according to claim 23, wherein said sculpted frame is covered with translucent multi-colored tubing through which stringed lights run.

25. A device according to claim 24, wherein said sculpted frame is formed of two halves connected by a hinge, said hinge being formed such that in a folded position said two halves are substantially parallel.

26. A device according to claim 24, wherein said sculpted frame is coated with a non-conductive material.

27. A device according to claim 20, wherein said appendage is rotatably attached to a secondary shaft fixed to said body and extending along the second axis, and said converting means converts the oscillating movement of said body about the first axis of said main shaft into synchronous oscillation of said appendage about the second axis of said secondary shaft.

28. A device according to claim 27, wherein said converting means comprises a linkage for converting the oscillating movement of said body about the first axis of said main shaft into the oscillating movement of said appendage about the second axis of said secondary shaft.

29. A device according to claim 28, wherein when said body rotates in a clockwise direction about the first axis of said main shaft, said linkage causes said appendage to rotate in a clockwise direction about the second axis of said secondary shaft.

30. A device according to claim 28, wherein said linkage comprises a link, with one end of said link being attached to said main shaft and an opposite end attached to said appendage.

31. A device according to claim 30, wherein said link is attached to said main shaft and said appendage via ball joints.

32. A device according to claim 27, wherein said appendage is rotatable in a plane parallel to an instant plane of said body.

33. A device according to claim 27, wherein said appendage includes a counterweight extending below a connection with said secondary shaft.

34. An animated display device comprising:

a main shaft having a first axis;

a secondary shaft having a second axis transverse to the first axis and being rotatably secured to said main shaft to oscillate in a first plane transverse to the first axis of said main shaft;

a body rotatably secured to said secondary shaft to oscillate with said secondary shaft about the first axis of said main shaft and about the second axis of said secondary shaft in planes transverse to the second axis;

driving means for driving said secondary shaft to oscillate about the first axis of said main shaft; and means for converting the oscillating movement of said secondary shaft about the first axis into the oscillating movement of said body about the second axis.

35. A device according to claim 34, wherein said driving means comprises an electric rotary motor.

36. A device according to claim 35, further comprising a drive disk affixed to said rotary motor and a driving link eccentrically connected to said drive disk, wherein said drive disk serves as a crank for moving said secondary shaft in the oscillating motion about the first axis.

37. A device according to claim 34, wherein said body comprises a sculpted frame formed of metal wire.

38. A device according to claim 37, wherein said sculpted frame is covered with translucent multi-colored tubing through which stringed lights run.

39. A device according to claim 38, wherein said sculpted frame is formed of two halves connected by a hinge, said hinge being formed such that in a folded position said two halves are substantially parallel.

40. A device according to claim 38, wherein said sculpted frame is coated with a non-conductive material.

41. A device according to claim 34, wherein said converting means comprises a linkage for converting the oscillating movement of said secondary shaft about the first axis of said main shaft into the oscillating movement of said body about the second axis of said secondary shaft.

42. A device according to claim 41, wherein when said secondary shaft rotates in a clockwise direction about the first axis of said main shaft, said linkage means causes said body to synchronously rotate in a counter-clockwise direction about the second axis of said secondary shaft.

43. A device according to claim 41, wherein said linkage comprises a series of links connected between a first bearing oscillatable about an axis parallel to the first axis of said main shaft and a second bearing oscillatable about said secondary shaft, said body being affixed to said second bearing.

44. A device according to claim 43, wherein the series of links in said linkage includes a first link affixed to said first bearing and extending in a second plane substantially parallel to the second axis and being rotatable with said first bearing in the second plane, a second link affixed to said second bearing, said second link being rotatable in planes substantially parallel to the first axis, and a third link having one end connected to a free end of said first link and an opposite end connected to a free end of said second link, said third link being movable relative to the free end of said first link in dual planes transverse to one another, and relative to the free end of said second link in planes substantially parallel to the first axis.

45. A device according to claim 44, wherein upon rotation of said secondary shaft about the first axis of said main shaft said first, second, and third links of said linkage interact to urge said second link to rotate said second bearing about said secondary shaft.

46. A device according to claim 44, wherein said first and third links are interconnected with a double-axis bearing and said second and third links are interconnected with a single-axis bearing.

47. An animated display device comprising:

frame means for supporting a display, said frame means including a fixed main shaft having a first axis;

a display supported by said frame means, said display having a first portion rotatably secured to said main shaft for oscillation about the first axis and a second portion rotatably secured to said first portion for oscillation about a second axis transverse to the first axis;

driving means for driving said first portion of said display to oscillate about the first axis of said main shaft; and a linkage for converting oscillating movement of said first portion into oscillation of said second portion about the second axis.

48. A device according to claim 47, wherein said second portion is secured to said first portion so as to oscillate about the first axis with said first portion.

49. A device according to claim 48, wherein said linkage comprises a first end pivotably fixed to an extension of said main shaft and a second end fixed to said second portion, such that oscillation of said first and second portion about the first axis oscillates said second portion about the second axis.

50. An animated display device comprising:

frame means for supporting a display, said frame means including a fixed main shaft having a first axis and a secondary shaft having a second axis and rotatably fixed to said main shaft;

a display supported on said frame for oscillation about the first axis of said main shaft and oscillation about the second axis of said secondary shaft;

driving means for driving said display to oscillate about the first axis of said main shaft; and a linkage for converting oscillation of said display about the first axis into oscillation of said display about the second axis.

51. A device according to claim 50, wherein said linkage includes a first link rotatably connected at a first end to an extension of said main shaft, a second link rotatably connected at one end to said secondary shaft, and a third link rotatably connected at a first end to a second end of said first link and rotatably connected at a second end to a second end of said second link.

52. A device according to claim 51, further comprising a first bearing connecting said first link to the extension of said main shaft for rotation about a third axis substantially parallel to the first axis.

53. A device according to claim 52, further comprising a second bearing connecting said second link to said secondary shaft for rotation about the second axis.

54. A device according to claim 53, further comprising a third bearing connecting said second link to said third link for relative rotational movement therebetween about a fourth axis substantially parallel to the second axis.

55. A device according to claim 54, further comprising a fourth bearing connecting said third link and said first link for relative rotational movement about a fifth axis substantially parallel to the first axis and a sixth axis substantially parallel to the second axis.

56. A device according to claim 55, wherein a linear distance between said first bearing and said second bearing changes as said display oscillates about the first axis of said main shaft to cause said linkage to oscillate said display about the second axis of said secondary shaft.

* * * * *